US006910291B2

(12) United States Patent
Schwass

(10) Patent No.: US 6,910,291 B2
(45) Date of Patent: Jun. 28, 2005

(54) GARMENT PRESSING STATION FOR PRESSING A FINISHED GARMENT

(75) Inventor: Carolyn Joyce Schwass, Jemison, AL (US)

(73) Assignee: Leonard Automatics, Inc., Dallas, NC (US)

( * ) Notice: Subject to any disclaimer, the term of this patent is extended or adjusted under 35 U.S.C. 154(b) by 173 days.

(21) Appl. No.: 10/192,100

(22) Filed: Jul. 11, 2002

(65) Prior Publication Data

US 2003/0037469 A1 Feb. 27, 2003

Related U.S. Application Data

(60) Provisional application No. 60/304,948, filed on Jul. 12, 2001.

(51) Int. Cl.[7] ..... D06F 77/00; D06F 81/00

(52) U.S. Cl. ..... 38/14

(58) Field of Search ..... 38/2, 3, 14, 1 A, 38/69, 70, 103, 104, 135, 107, 66, 112, 140; 223/66, 67, 68, 71, 72, 70, 73; 68/222

(56) References Cited

U.S. PATENT DOCUMENTS

| | | | | | |
|---|---|---|---|---|---|
| 2,287,646 | A | * | 6/1942 | Steele | 108/99 |
| 3,171,575 | A | * | 3/1965 | Richterkessing | 223/73 |
| 3,248,813 | A | * | 5/1966 | Quick | 38/77.6 |
| 3,620,055 | A | * | 11/1971 | Blachly et al. | 68/222 |
| 3,865,285 | A | * | 2/1975 | McCormack et al. | 223/73 |
| 3,964,185 | A | * | 6/1976 | Bullock et al. | 38/14 |
| 4,173,300 | A | | 11/1979 | Sanko | |
| 4,346,826 | A | | 8/1982 | Ehemann | |
| 4,689,905 | A | | 9/1987 | Vartan | |
| 4,875,301 | A | * | 10/1989 | Adams | 38/14 |
| 5,359,792 | A | * | 11/1994 | Hanada et al. | 38/72 |

* cited by examiner

*Primary Examiner*—Ismael Izaguirre
(74) *Attorney, Agent, or Firm*—Adams Evans P.A.

(57) ABSTRACT

A garment pressing station is adapted for pressing a finished garment. The pressing station includes a supporting frame and a vertical press board carried by the frame. A hand-held iron is suspended from the frame, and adapted for engaging and pressing the garment on the vertical press board.

30 Claims, 8 Drawing Sheets

GARMENT PRESSING STATION FOR PRESSING A FINISHED GARMENT

TECHNICAL FIELD AND BACKGROUND OF THE INVENTION

This invention relates to a garment pressing station for pressing a finished garment. The invention is especially applicable for use in conjunction with any commercial tunnel finisher used in the garment processing industry. An operator transfers the garment on a hanger directly from the tunnel finisher to the invention where wrinkles in the garment are manually removed by pressing with an iron. The invention reduces pressing time and labor while improving operator ergonomics.

SUMMARY OF THE INVENTION

Therefore, it is an object of the invention to provide a garment pressing station which allows an operator to quickly and conveniently touch-up finished garments while still on the hanger.

It is another object of the invention to provide a garment pressing station which improves operator efficiency.

It is another object of the invention to provide a garment pressing station which is ergonomically designed.

It is another object of the invention to provide a garment pressing station which utilizes a self-contained vacuum system.

It is another object of the invention to provide a garment pressing station which has a relatively small, space-saving footprint.

It is another object of the invention to provide a garment pressing station which is relatively inexpensive to manufacture.

It is another object of the invention to provide a garment pressing station which is relatively easy to install and operate.

It is another object of the invention to provide a garment pressing station which can accommodate a wide variety of garment sizes.

It is another object of the invention to provide an improved method of pressing a finished garment.

These and other objects of the present invention are achieved in the preferred embodiments disclosed below by providing a garment pressing station for pressing a finished garment. The pressing station includes a supporting frame and a vertical press board carried by the frame. A hand-held iron is suspended from the frame, and is adapted for engaging and pressing the garment on the vertical press board.

According to another preferred embodiment of the invention, the vertical press board includes a vacuum buck with a perforated front wall, a rear wall, and opposing side and end walls cooperating to define an interior vacuum chamber.

According to another preferred embodiment of the invention, the vertical press board further includes an air permeable pad overlying the perforated front wall of the vacuum buck.

According to another preferred embodiment of the invention, the vertical press board further includes a fabric cover applied to the vacuum buck and covering the perforated front wall and pad.

According to another preferred embodiment of the invention, the garment pressing station includes a vacuum source with an elongated hose connected to the rear wall of the vacuum buck. The hose communicates with the vacuum chamber for drawing air inwardly through the perforated front wall.

According to another preferred embodiment of the invention, a foot pedal is operatively connected to the vacuum source for controlling operation of the vacuum source.

According to another preferred embodiment of the invention, the frame includes an overhead rail, and the pressing station further includes a sliding trolley attached to the overhead rail. The trolley is adapted for sliding movement from one end of the rail to the other. An elongated iron cord connects the hand-held iron to the trolley.

According to another preferred embodiment of the invention, a tool balancing device is connected to the iron cord for providing controlled extension and retraction of the cord upon manipulation of the hand-held iron by a user.

According to another preferred embodiment of the invention, a sleeve board is carried by a mounting arm attached to the frame and adapted for receiving a portion of the garment for pressing.

According to another preferred embodiment of the invention, the sleeve board is pivot attached to the mounting arm for pivoting movement between a horizontal in-use position and a vertical non-use position.

According to another preferred embodiment of the invention, a water spray device is provided for applying water to the garment during pressing.

According to another preferred embodiment of the invention, a garment hanger chain is suspended from the frame for supporting a hanger carrying the garment to be pressed.

According to another preferred embodiment of the invention, the chain includes a series of links each adapted for receiving the hanger to locate the garment at a desired height relative to the vacuum board.

According to another preferred embodiment of the invention, the vertical press board is pivot attached at its upper end to the frame.

According to another preferred embodiment of the invention, a tilt angle adjustment plate is attached to the frame and adapted for engaging a lower end of the vertical press board to adjust the angle of the vertical press board relative to the frame.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
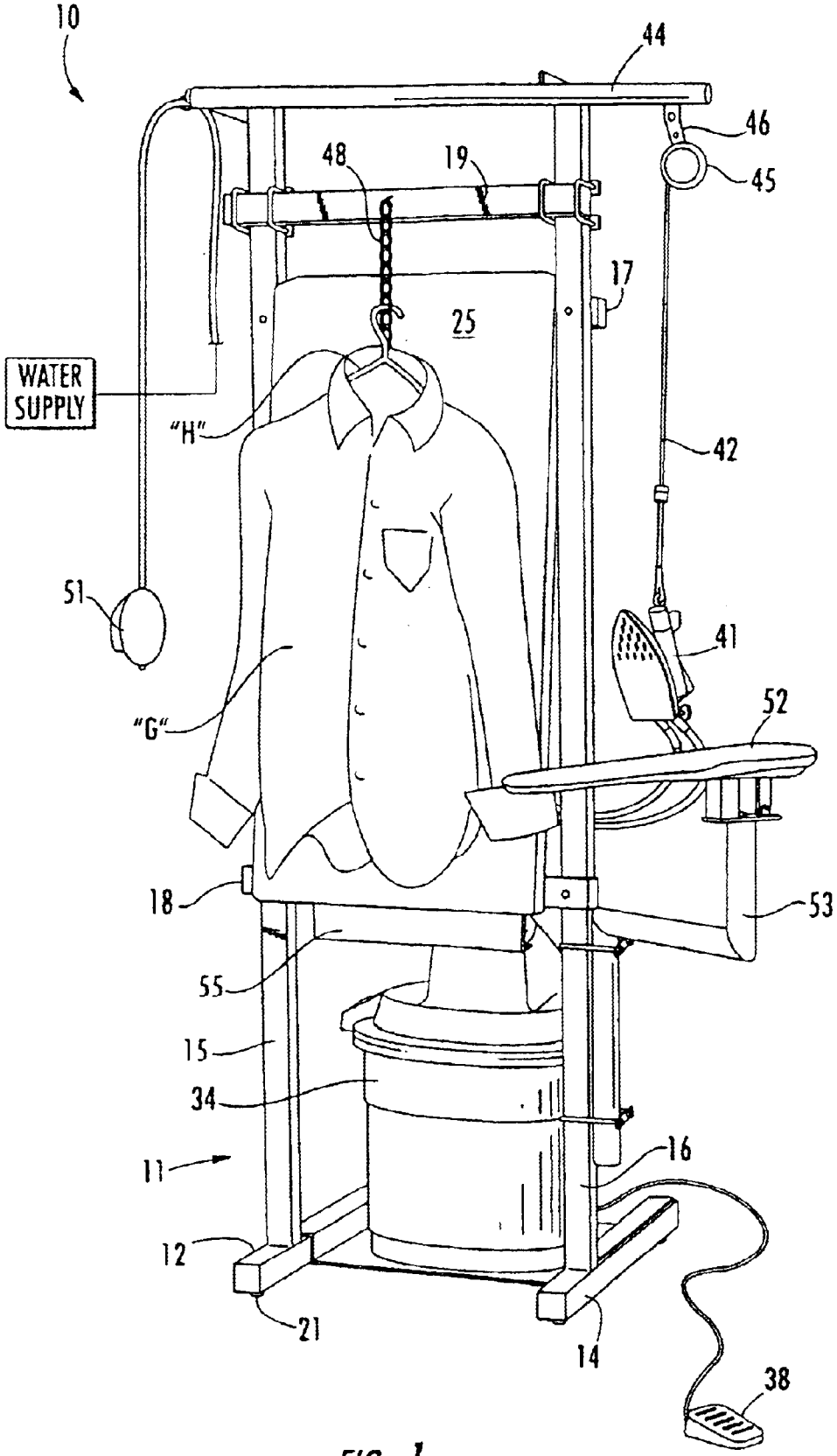
FIG. 1 is a perspective view of the garment pressing station according to one preferred embodiment, and showing a garment carried by a hanger and positioned relative to the vertical press board for finish pressing.

Referring now specifically to the drawings, a garment pressing station according to the present invention is illustrated in FIG. 1 and shown generally at reference numeral 10. The pressing station 10 is especially applicable for finish pressing garments "G" taken directly from a commercial tunnel finisher. An example of a tunnel finisher is described in Applicant's prior issued U.S. Pat. No. 6,311,526. The complete disclosure of this patent is incorporated herein by reference.

Figure 2:
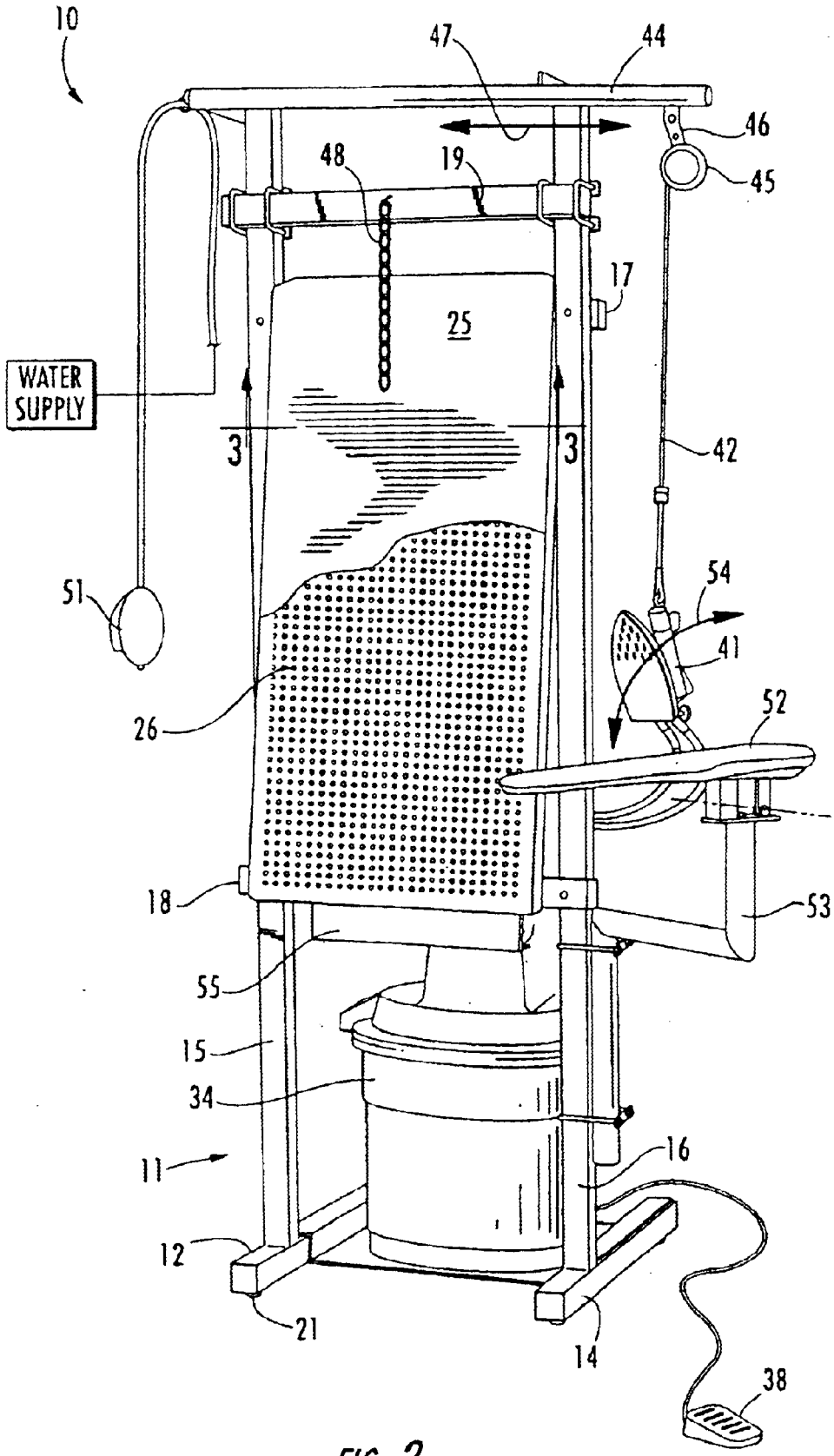
FIG. 2 is a perspective view of the garment pressing station with a portion of the garment press board removed to illustrate the perforated front press pan of the vacuum buck.

As shown in FIGS. 1 and 2, the pressing station 10 includes a square-tube steel frame 11 comprising spaced-apart base members 12, 14, a pair of vertical frame members 15, 16 mounted on respective base members 12, 14, a pair of spaced horizontal frame members 17, 18 attached to respective vertical frame members 15, 16, and a cross-brace 19. The frame members are preferably assembled together using bolt-together construction for increased strength and easy installation. Manual leveling pads 21 are located on opposite ends of the base members 12, 14 to allow convenient leveling adjustment, and to keep the frame 11 off the plant floor.

Figure 3:
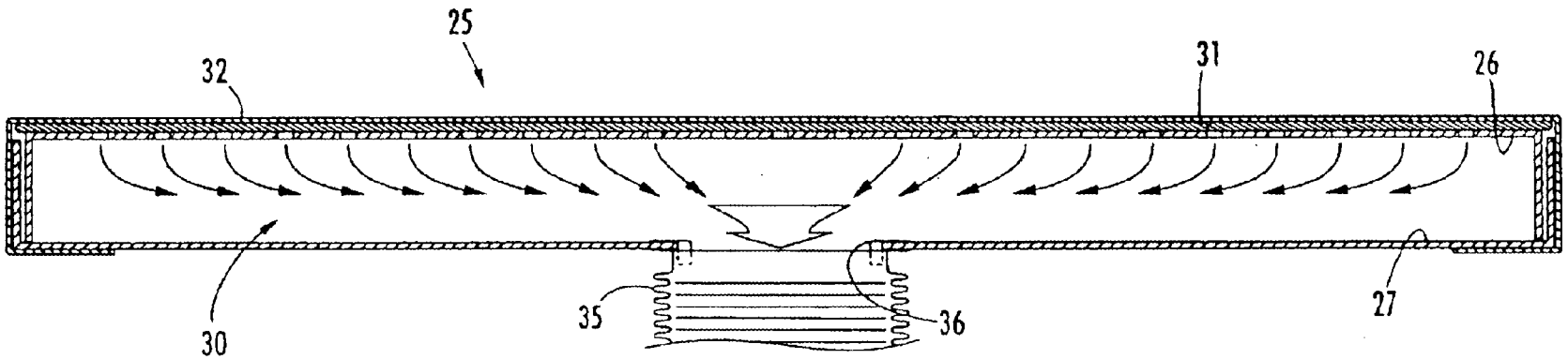
FIG. 3 is a cross-sectional view of the garment press board taken substantially along lines 3—3 of FIG. 2.
Figure 4:
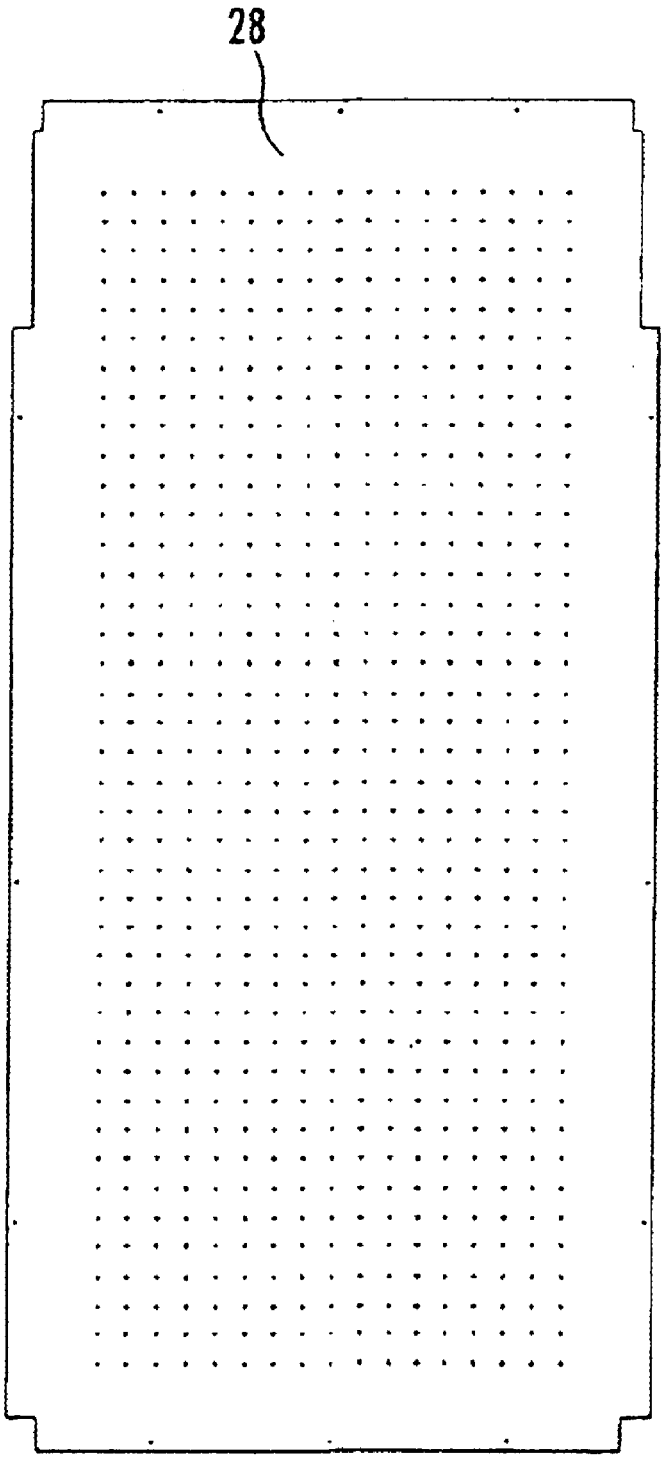
FIG. 4 is a plan view of the metal sheet forming the front press pan.
Figure 5:
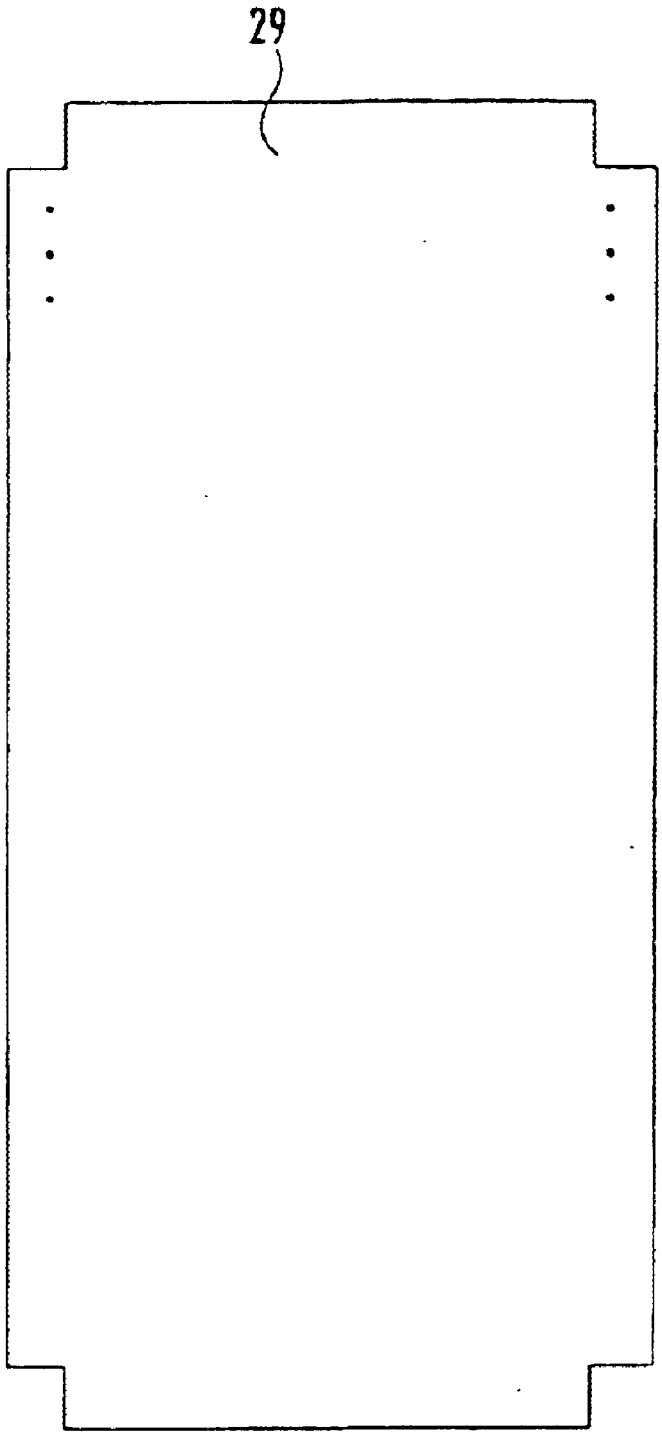
FIG. 5 is a plan view of the metal sheet forming the rear press pan.
Figure 6:
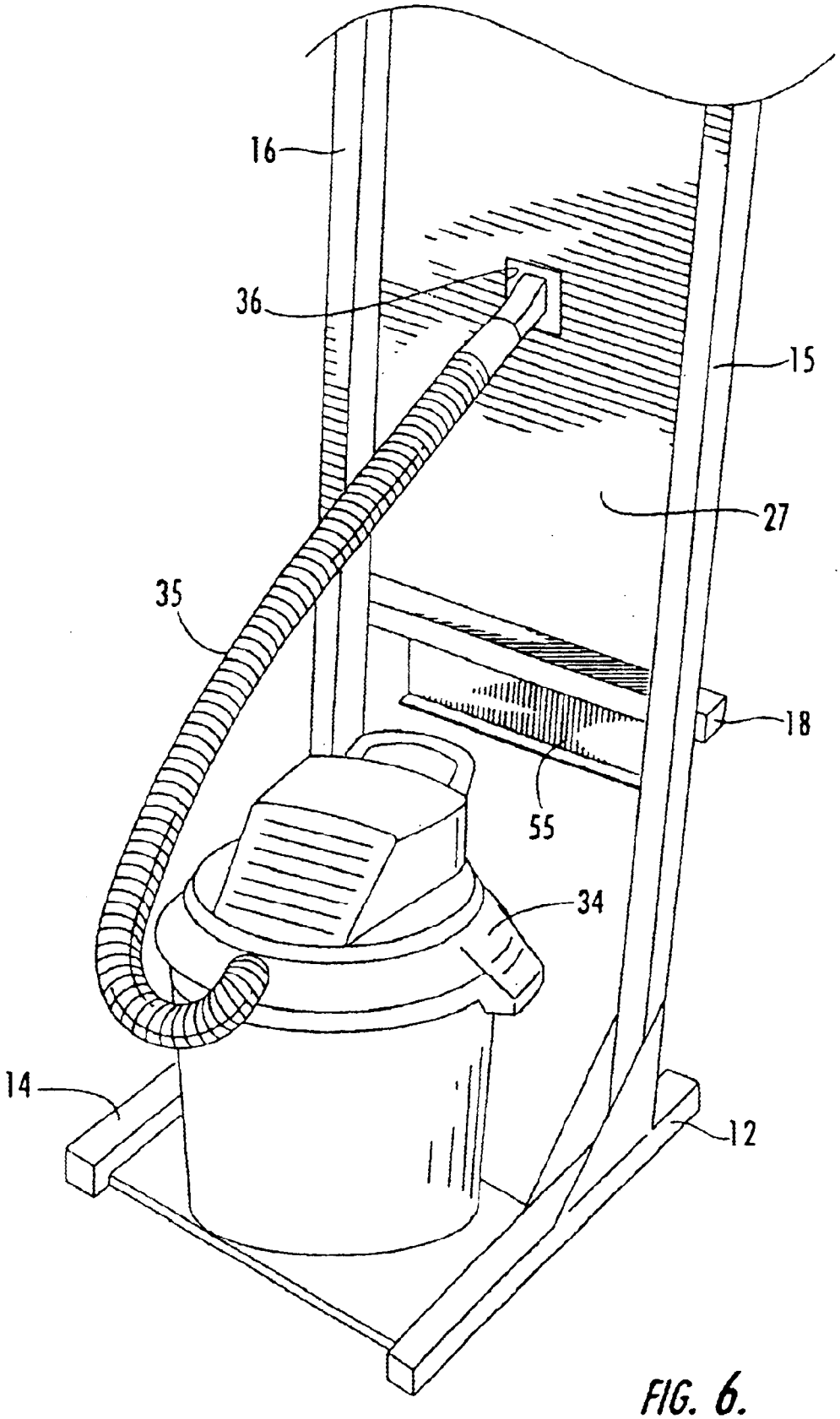
FIG. 6 is a fragmentary rear view of the garment pressing station showing the vacuum hose connected to the rear press pan of the vacuum buck.

The horizontal frame members 17, 18 support a relatively large garment press board 25. In one preferred embodiment, the dimensions of the press board are approximately 20"× 44"×2". The top of the press board 25 is pivotally attached to the upper frame member 17, while the bottom of the board 25 rests against the lower frame member 18. As best shown in FIG. 3, the press board 25 comprises a vacuum buck constructed of complementary front and rear press pans 26 and 27. The press pans 26, 27 are formed, respectively, from galvanized metal sheets 28 and 29 shown in FIGS. 4 and 5. The sheet 28 is perforated with solid marginal edges folded outwardly to define respective top, bottom, and side walls of the front pan 26. The sheet 29 is solid with solid marginal edges folded outwardly to define respective top, bottom, and side walls of the rear pan 27. The rear pan 27 is slightly larger than the front pan 26, as shown in FIG. 3, such that the pans 26, 27 nest together when assembled to form an interior vacuum chamber 30. An air-permeable felt pad 31 and fabric cover 32 are applied over the perforated front of the assembled pans 26, 27. As best shown in FIGS. 3 and 6, a conventional vacuum source 34, such as that sold commercially under the brand name SHOP-VAC®, communicates with the vacuum chamber 30 through an elongated hose 35 connected to a central opening 36 formed with the rear pan 27. The vacuum source 34 is operatively connected to a foot pedal 38 for convenient activation by a user.

Referring again to FIGS. 1 and 2, a hand-held, all steam iron 41 is attached to an iron cord 42 and suspended from an overhead support rail 44 located above the garment press board 25. The iron cord 42 is connected to a tool balancing device 45 carried by a sliding trolley 46 designed for sliding movement, as indicated at 47, from one side of garment pressing station 10 to the other. The tool balancing device 45 has an internal spring which operates to provide controlled extension and recoiling of the cord 42 upon manipulation of the iron 41 by the user.

The garment "G" is carried on a hanger "H" and suspended from the cross brace 19 of the frame 11 by a hanger chain 48. The hanger chain 48 is formed of interconnected links designed for selectively receiving the hook portion of the hanger "H" to located the garment "G" at a desired height relative to the press board 25. When the vacuum source 34 is activated by the user, air is drawn inwardly through the perforated front of the press board 25 to suction the garment "G" against the fabric cover 32 and felt pad 31. The suction force evacuates moisture from the garment "G", and provides positioning means for holding the garment "G" in place during manual pressing. The sliding trolley 46 and tool balancing device 45 cooperate to allow convenient movement of the iron 41 both vertically and horizontally to any location on the garment press board 25. A water spray nozzle 51 may be used during pressing to apply a light mist to the garment "G". For cuff and sleeve pressing, the garment pressing station 10 includes a fabric covered, felt-padded sleeve board 52 pivotally attached to a mounting arm 53 secured to the vertical frame member 16. When not in use, the sleeve board 52 can be pivoted upwardly, as indicated by arrow 54, to a non-use position out of the way of the user.

Figure 7:
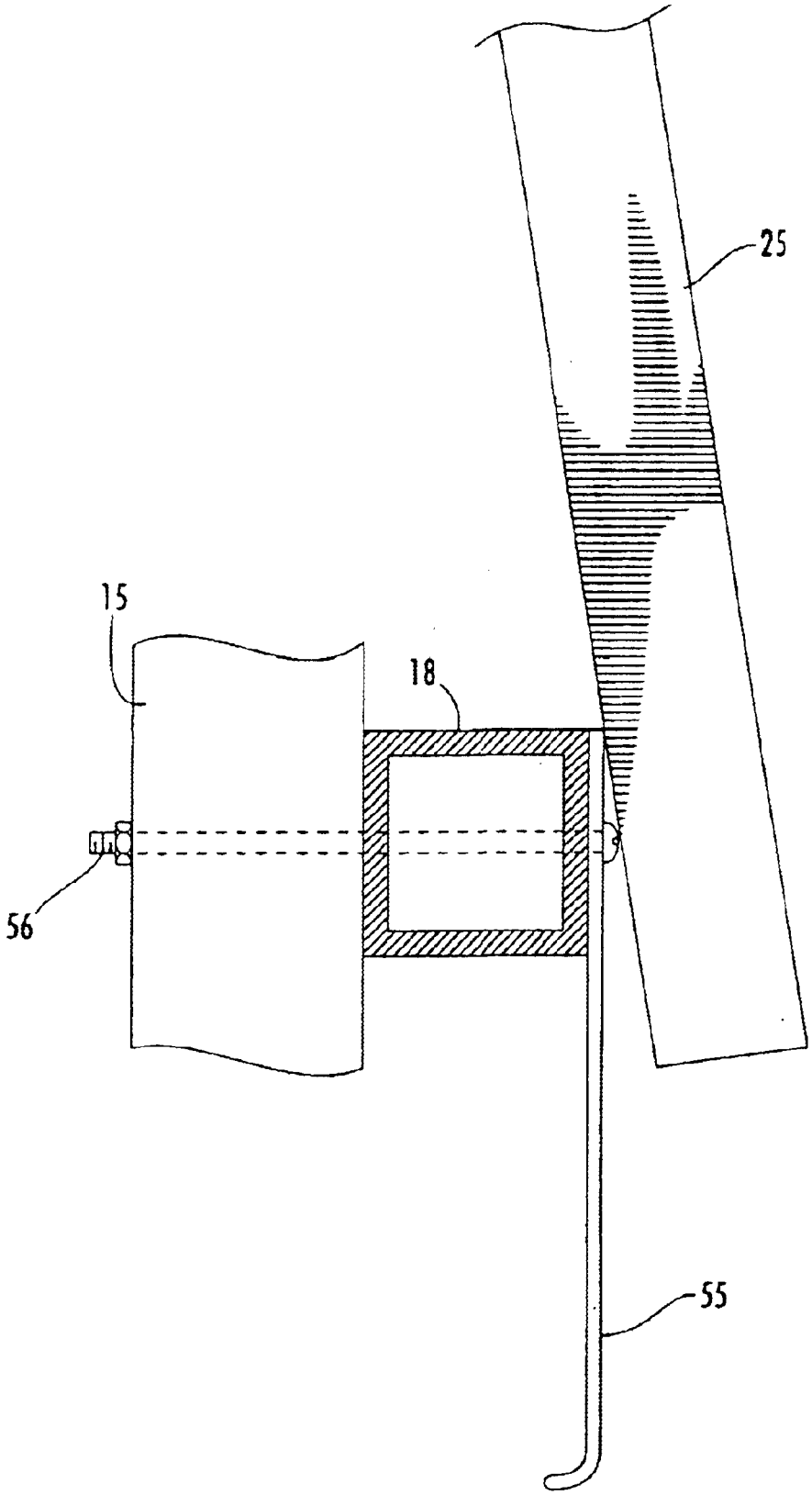
FIG. 7 is a fragmentary, enlarged elevational view showing the tilt angle adjustment plate in a vertical position to orient the garment press board at a slight angle relative to the user.
Figure 8:
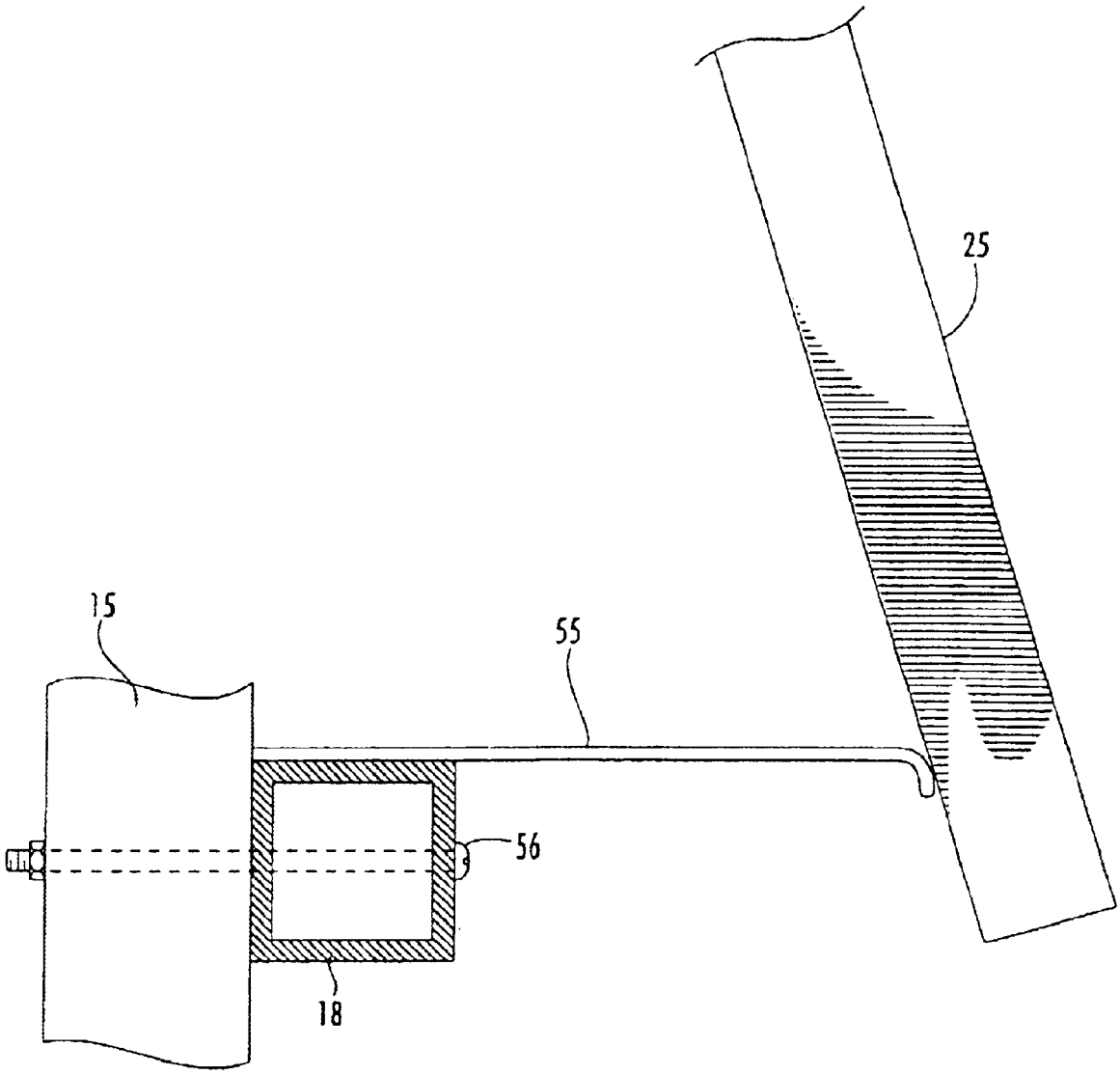
FIG. 8 is a fragmentary, enlarged elevational view showing the tilt angle adjustment plate in a horizontal position to orient the garment press board at an increased angle relative to the user.

Referring to FIGS. 7 and 8, in an effort to further accommodate characteristics of the particular user, a tilt angle adjustment plate 55 is attached by bolts 56 to the lower horizontal frame member 18 of the support frame 11. In the position shown in FIG. 7, the tilt angle adjustment plate 55 extends vertically downward relative to the garment press board 25. The garment press board 25 is slightly angled relative to the vertical frame members 15, 16 in a first pressing position. The tilt angle of the garment press board 25 is increased by removing the bolts 56 and rotating the lower frame member 18 upwardly such that the tilt angle adjustment plate 55 extends horizontally outward, as shown in FIG. 8. The bolts 56 are then reinserted through aligned openings formed through the frame members 15, 16, and 18. The garment press board 25 pivots further outwardly into a second pressing position. The alternate pressing positions promote the ergonomic design of the garment pressing station 10, and serve to increase user efficiency and the overall quality of work.

A garment pressing station for pressing a finished garment is described above. Various details of the invention may be changed without departing from its scope. Furthermore, the foregoing description of the preferred embodiment of the invention and the best mode of practicing the invention are provided for the purpose of illustration only and not for the purpose of limitation—the invention being defined by the claims.

I claim:

1. A garment pressing station for pressing a finished garment, said pressing station comprising:

(a) a supporting frame;

(b) vertical press board carried by said frame; and (c) a hand-held iron suspended from said frame, and adapted for engaging and pressing the garment on said vertical press board.

2. A garment pressing station according to claim 1, wherein said vertical press board comprises a vacuum buck including a perforated front wall, a rear wall, and opposing side and end walls cooperating to define an interior vacuum chamber.

3. A garment pressing station according to claim 2, wherein said vertical press board further comprises an air permeable pad overlying the perforated front wall of said vacuum buck.

4. A garment pressing station according to claim 3, wherein said vertical press board further comprises a fabric cover applied to said vacuum buck and covering said perforated front wall and pad.

5. A garment pressing station according to claim 2, and comprising a vacuum source with an elongated hose connected to the rear wall of said vacuum buck and communicating with said vacuum chamber for drawing air inwardly through said perforated front wall.

6. A garment pressing station according to claim 5, and comprising a foot pedal operatively connected to said vacuum source for controlling operation of said vacuum source.

7. A garment pressing station according to claim 1, wherein said frame comprises an overhead rail, and wherein said pressing station further comprises a sliding trolley attached to said overhead rail and adapted for sliding movement from one end of said rail to the other, and an elongated iron cord connecting said hand-held iron to said trolley.

8. A garment pressing station according to claim 7, and comprising a tool balancing device connected to said iron cord for providing controlled extension and retraction of said cord upon manipulation of said hand-held iron by a user.

9. A garment pressing station according to claim 1, and comprising a sleeve board carried by a mounting arm attached to said frame and adapted for receiving a portion of the garment for pressing.

10. A garment pressing station according to claim 9, wherein said sleeve board is pivot attached to said mounting arm for pivoting movement between a horizontal in-use position and a vertical non-use position.

11. A garment pressing station according to claim 1, and comprising a water spray device for applying water to the garment during pressing.

12. A garment pressing station according to claim 1, and comprising a garment hanger chain suspended from said frame for supporting a hanger carrying the garment to be pressed.

13. A garment pressing station according to claim 12, wherein said chain comprises a series of links each adapted for receiving the hanger to locate the garment at a desired height relative to said vacuum board.

14. A garment pressing station according to claim 1, wherein said vertical press board is pivot attached at an upper end thereof to said frame.

15. A garment pressing station according to claim 14, and comprising a tilt angle adjustment plate attached to said frame and adapted for engaging a lower end of said vertical press board to adjust the angle of said vertical press board relative to said frame.

16. A garment pressing station for pressing a finished garment, said pressing station comprising:

(a) a supporting frame;

(b) vertical press board carried by said frame, said press board comprising a vacuum buck including a perforated front wall, a rear wall, and opposing side and end walls cooperating to define an interior vacuum chamber;

(c) a vacuum source communicating with said vacuum chamber for drawing air inwardly through said perforated front wall; and (d) a hand-held iron suspended from said frame, and adapted for engaging and pressing the garment on said vertical press board.

17. A garment pressing station according to claim 16, wherein said vertical press board comprises an air permeable pad overlying the perforated front wall of said vacuum buck.

18. A garment pressing station according to claim 17, wherein said vertical press board further comprises a fabric cover applied to said vacuum buck and covering said perforated front wall and pad.

19. A garment pressing station according to claim 16, and comprising a foot pedal operatively connected to said vacuum source for controlling operation of said vacuum source.

20. A garment pressing station according to claim 16, wherein said frame comprises an overhead rail, and wherein said pressing station further comprises a sliding trolley attached to said overhead rail and adapted for sliding movement from one end of said rail to the other, and an elongated iron cord connecting said hand-held iron to said trolley.

21. A garment pressing station according to claim 20, and comprising a tool balancing device connected to said iron cord for providing controlled extension and retraction of said cord upon manipulation of said hand-held iron by a user.

22. A garment pressing station according to claim 16, and comprising a sleeve board carried by a mounting arm attached to said frame and adapted for receiving a portion of the garment for pressing.

23. A garment pressing station according to claim 22, wherein said sleeve board is pivot attached to said mounting arm for pivoting movement between a horizontal in-use position and a vertical non-use position.

24. A garment pressing station according to claim 16, and comprising a water spray device for applying water to the garment during pressing.

25. A garment pressing station according to claim 16, and comprising a garment hanger chain suspended from said frame for supporting a hanger carrying the garment to be pressed.

26. A garment pressing station according to claim 25, wherein said chain comprises a series of links each adapted for receiving the hanger to locate the garment at a desired height relative to said vacuum board.

27. A garment pressing station according to claim 16, wherein said vertical press board is pivot attached at an upper end thereof to said frame.

28. A garment pressing station according to claim 27, and comprising a tilt angle adjustment plate attached to said frame and adapted for engaging a lower end of said vertical press board to adjust the angle of said vertical press board relative to said frame.

29. A method for finish pressing a garment, said method comprising the steps of:

(a) hanging the garment vertically from a supporting frame of a garment pressing station;

(b) suctioning the garment to a vertical press board carried by the supporting frame of the garment pressing station; and (c) applying a hand-held iron to the garment for engaging and pressing the garment on the vertical press board.

30. A method according to claim 29, and comprising the step of carrying the garment on a hanger suspended from the frame by a garment hanger chain, the garment hanger chain having a series of links each adapted for receiving the hanger to locate the garment at a desired height relative to the vacuum board.

* * * * *